US008833116B1

(12) United States Patent
Brown

(10) Patent No.: US 8,833,116 B1
(45) Date of Patent: Sep. 16, 2014

(54) ANTI-THEFT RING ASSEMBLY AND METHOD OF USE

(71) Applicant: R&J Manufacturing Company, Johnston, RI (US)

(72) Inventor: David W. Brown, Cumberland, RI (US)

(73) Assignee: R & J Manufacturing Company, Johnston, RI (US)

( * ) Notice: Subject to any disclaimer, the term of this patent is extended or adjusted under 35 U.S.C. 154(b) by 0 days.

(21) Appl. No.: 13/837,832

(22) Filed: Mar. 15, 2013

(51) Int. Cl.
*E05B 65/00* (2006.01)
*E05B 73/00* (2006.01)

(52) U.S. Cl.
CPC ..... *E05B 73/0011* (2013.01)
USPC .... 70/57.1; 70/14; 70/58; 206/6.1; 340/568.2

(58) Field of Classification Search
USPC ..... 70/14, 57.1, 58, 63; 340/568.2, 568.8, 340/537, 652; 206/6.1, 566
See application file for complete search history.

(56) References Cited

U.S. PATENT DOCUMENTS 3,668,681 A * 6/1972 Kaplan ..... 340/537
4,074,637 A * 2/1978 Lorenzen, Jr. ..... 109/38
4,300,674 A * 11/1981 Davet ..... 206/6.1
5,437,172 A * 8/1995 Lamy et al. ..... 70/57.1
D363,087 S * 10/1995 McAuley ..... D20/22
5,535,878 A * 7/1996 Reed ..... 206/6.1
D379,100 S * 5/1997 McAuley et al. ..... D20/22
D385,579 S * 10/1997 McAuley et al. ..... D20/27
5,709,110 A * 1/1998 Greenfield et al. ..... 70/58
5,720,498 A * 2/1998 McAuley et al. ..... 283/79
6,006,899 A * 12/1999 McAuley et al. ..... 206/6.1
6,199,309 B1 * 3/2001 Markarian ..... 40/299.01
6,476,717 B1 * 11/2002 Gross et al. ..... 340/568.1
7,360,379 B1 * 4/2008 Lopez ..... 70/58
7,714,721 B1 * 5/2010 Feibelman et al. ..... 340/568.1
7,971,845 B2 * 7/2011 Galant ..... 248/551
8,044,806 B2 * 10/2011 Sayegh ..... 340/572.9
8,558,688 B2 * 10/2013 Henson et al. ..... 340/539.1
8,590,699 B2 * 11/2013 Feibelman et al. ..... 206/6.1
2002/0134119 A1 * 9/2002 Derman ..... 70/58
2003/0010070 A1 * 1/2003 Kolton et al. ..... 70/57.1
2004/0145473 A1 * 7/2004 Royer ..... 340/568.2
2008/0034815 A1 * 2/2008 Fawcett et al. ..... 70/57.1
2011/0080137 A1 * 4/2011 Avganim ..... 320/115
2011/0187531 A1 * 8/2011 Oehl et al. ..... 340/568.1
2011/0283754 A1 * 11/2011 Ezzo et al. ..... 70/57.1
2012/0042702 A1 * 2/2012 Ezzo et al. ..... 70/57.1
2012/0119910 A1 * 5/2012 Belden et al. ..... 340/568.8
2012/0255331 A1 * 10/2012 Markarian, Jr. ..... 70/14

* cited by examiner

*Primary Examiner* — Suzanne Barrett
(74) *Attorney, Agent, or Firm* — Dingman, McInnes & McLane, LLP

(57) ABSTRACT

An anti-theft ring assembly includes a product engagement member having a display member that supports the ring during use and a securing member (for example a tear resistant tie or strap) that secures the ring to the display member; the anti-theft ring assembly also including an anchoring device having a support member and a tether for securing the product engagement member to the support member while allowing removal of the product engagement member from a display. In one embodiment, the support member may include a base having protrusions for connecting the tether thereto and the display member may be a seat for supporting a shank of the ring and a portion of the tether.

20 Claims, 16 Drawing Sheets

ANTI-THEFT RING ASSEMBLY AND METHOD OF USE

TECHNICAL FIELD

This invention relates generally to an anti-theft ring assembly and method for protecting consumer products from theft, and more particularly, to an improved anti-theft ring assembly for displaying a product in a manner which allows the product to be handled by a consumer while also reducing the likelihood of theft of the product.

BACKGROUND

Surveillance systems that prevent or deter theft of merchandise from retail stores are well known in the art. For example, retail stores often utilize electronic article surveillance (EAS) markers or tags that activate an alarm upon removal of the product from the store in order to discourage the theft of consumer products. These types of markers are typically secured to the product and are either removed or rendered inactive at checkout. In some cases the markers are visible to consumers, and in other cases the markers are hidden from view in order to prevent unauthorized removal. In either case, if the markers are not rendered inactive or removed, they will be sensed by the EAS system causing an alarm to signal, usually when exiting the retail store. The use of such markers or tags to trigger an alarm has been successful in deterring the theft of most types of merchandise. However, the use of such markers with certain types of merchandise has not always been successful due to the nature of the products to be tagged. For example, some products are inherently difficult to tag, either due to their size or ease of removal of the tag. One higher price item that is difficult to effectively attach an electronic sensor to is a ring. It can be difficult to attach sensors to the band or shank of a ring because if the sensors are overly rigid or cumbersome they can limit the customer's ability to try on the ring before purchasing. However, if the tag is easily removed it will not serve as a deterrent. Thus, tags to prevent theft are often attached to rings by using a thin, yet flexible, tear resistant plastic strap.

For example, one such tag is disclosed in U.S. Pat. No. 5,720,498. In the '498 patent the anti-theft tag includes an elongated housing that is attached to the ring by a tear resistant strap that is secured to an outer surface of the tag by a pressure sensitive adhesive. The tag is inserted within a ring display system that includes slots for receiving the body of the anti-theft tag. While generally effective, attaching the strap to the outside of a tag may allow a consumer to tamper with the attachment of the strap in an attempt to remove it.

Another such tag is U.S. Pat. No. 7,714,721, which is owned by the assignee of the present application. In the '721 patent the anti-theft tag includes an elongated housing for accommodating an EAS marker, a product support member that locks into the housing and which supports the ring, and a flexible, tear resistant strap for securing the ring to the support member, with the strap being disposed at least partially within the housing during use. In use, the tear resistant strap extends over the ring shank and the ends of the strap are received within the cavity of the housing in order to protect the strap from unauthorized removal by a consumer.

Alternately, anti-theft markers may be hidden in a holder displaying the product, for example by hiding an EAS marker in a display box for holding and displaying the ring. Although placing the marker in the holder displaying the product has also had some success, if the product is removed from the holder, it no longer has an anti-theft tag associated with it.

Thus, a person desiring to steal an item, such as an article of jewelry (for example a ring), will often simply remove the ring from its display box as they pretend to try on the ring. When the ring is removed from the box, the thief leaves behind any EAS marker contained in the box. In an attempt to deter the theft of expensive items of jewelry, some retailers lock the items behind display cases, and only remove them upon the request of the customer. This requires the retailer to take out each item of jewelry individually and stay with the customer as he or she handles the item, because upon removal from the locked case the item becomes vulnerable to theft, which is time consuming and cumbersome.

SUMMARY

Although the aforementioned devices provide a level of security against theft of items such as rings, there is a continued need in the art for an improved anti-theft device, which can be used to display a product to a consumer, allow the consumer to handle the product in some manner (such as by trying on the product), while also deterring the theft of the product.

The anti-theft ring assembly of the present application includes a product engagement member including a display member that supports the ring during use and a securing member (for example a tear resistant tie or strap) that attaches the ring to the display member, and an anchoring device including a support member and a tether for securing the product engagement member to the support member while allowing removal of the product engagement member from a product display, for example a box.

In one embodiment, the display member includes a curved or arcuate support for supporting a circular shank portion of the ring and the tie is an adjustable cable tie, as is known in the art. The support may be a card that includes protrusions for connecting the tether thereto.

The anti-theft ring assembly described herein is tamper resistant, even when a consumer rotates or twists the ring, thus discouraging unauthorized removal of the ring. The anti-theft ring assembly also does not improperly interfere with a consumer trying on the ring, is readily attached to the ring and is aesthetically pleasing. The features of the anti-theft tag as described herein may be used with any of a variety of rings, and may be supported on a variety of display devices as discussed below.

BRIEF DESCRIPTION OF THE DRAWINGS

The foregoing and other objects, features and advantages will be apparent from the following description of particular embodiments, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF THE ILLUSTRATIVE EMBODIMENTS

The embodiments disclosed herein relate to an anti-theft assembly for use with a product, for example a ring. As used herein, the term "ring" refers to any jewelry item having a generally circular shank, including but not limited to finger rings, toe rings, earrings and bellybutton rings. As also used herein, the term "electronic article surveillance" (EAS) tag, sensor, label or marker refers to any conventionally available article surveillance sensor that triggers an alarm if not detached or disarmed before the product is removed from a designated area, such as a store, as is known in the art. Although referred to as "electronic", EAS sensors as used herein include and sensor that triggers an alarm if not deactivated, disarmed, or removed, including, but not limited to conventional electronic sensors such as acousto-magnetic (A/M) sensors, magnetic sensors, radio-frequency (RF) sensors, and the like, as would be known to those of skill in the art.

Figure 1:
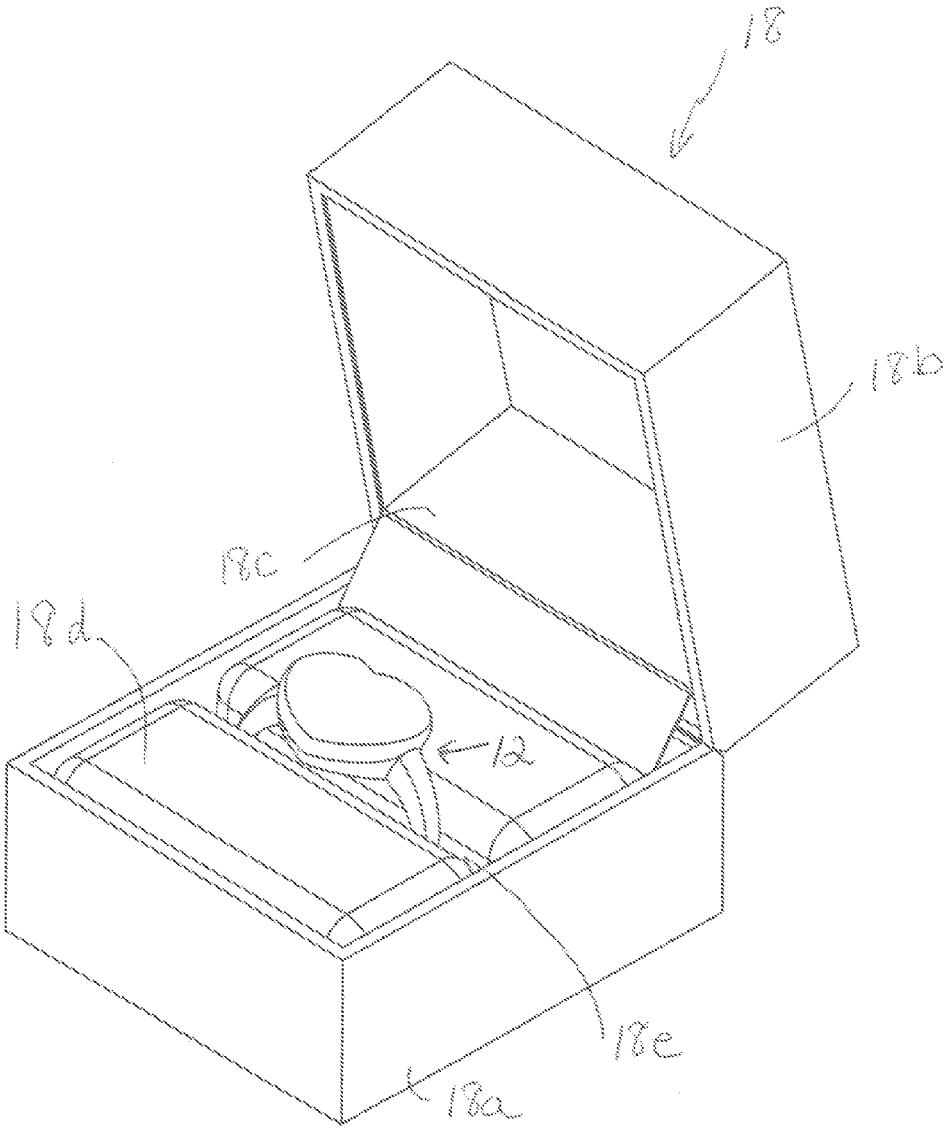
FIG. 1 is a front, perspective view of an anti-theft ring assembly according to the present disclosure fully assembled and illustrating display of the product within the box in an open position.
Figure 2:
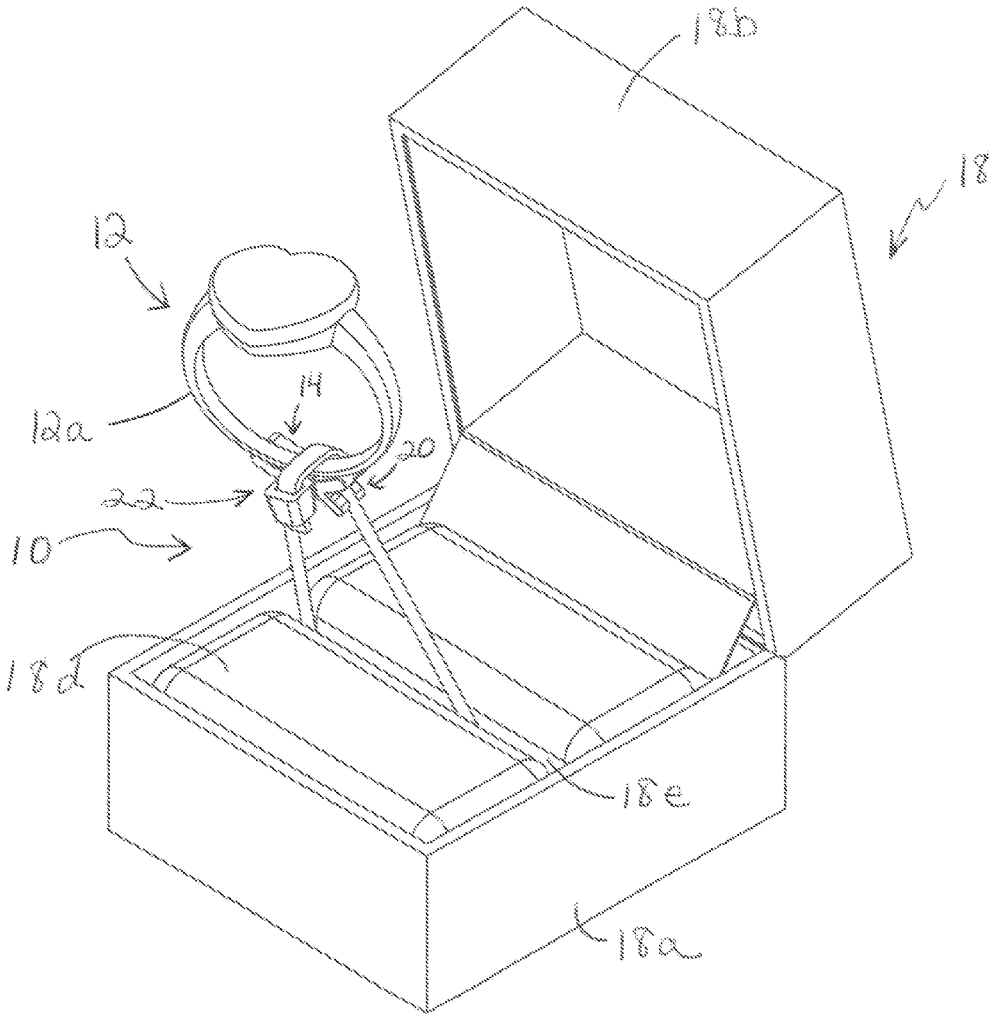
FIG. 2 is a perspective view of the anti-theft ring assembly of FIG. 1 illustrating operation with the product and the box in the open position.
Figure 3:
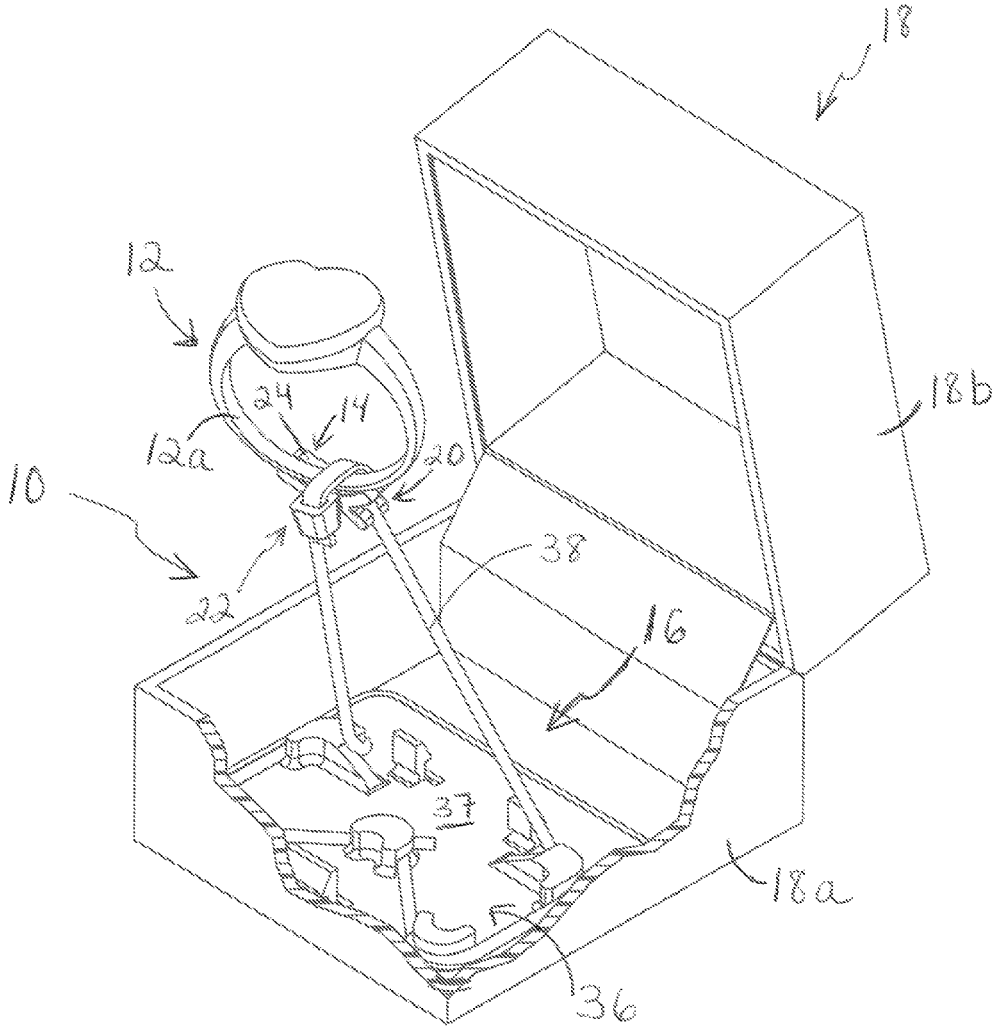
FIG. 3 is a partial sectional view of the anti-theft ring assembly of FIG. 2 with padding removed.
Figure 18:
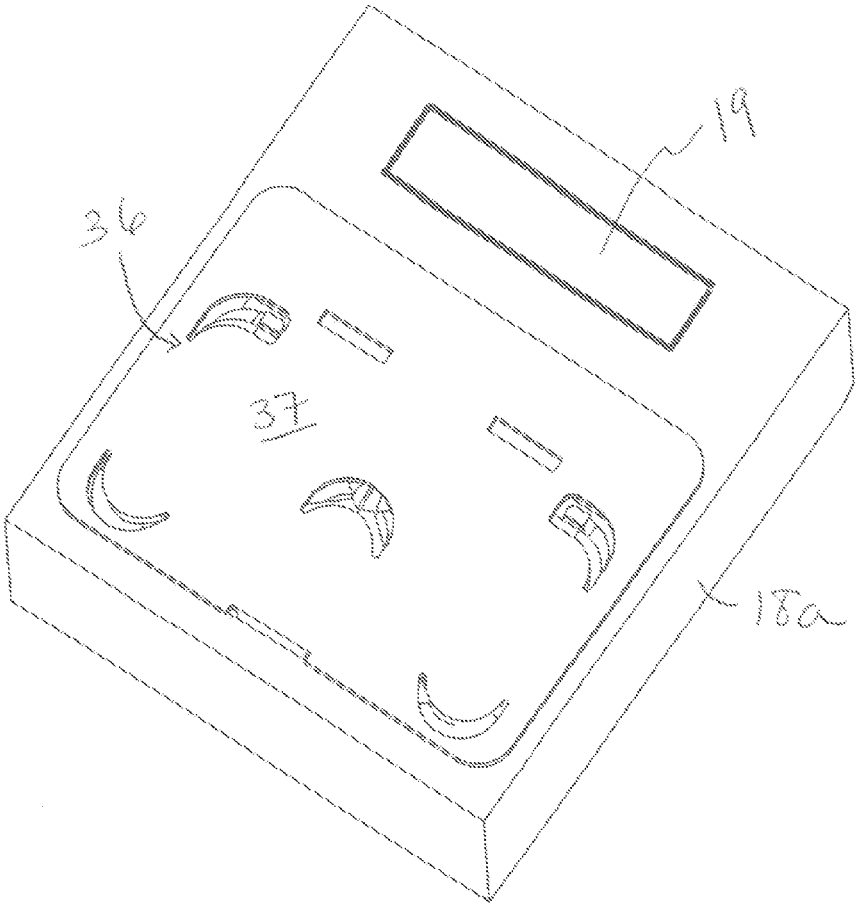
FIG. 18 is bottom, perspective view of box of FIG. 1.

Referring initially to FIGS. 1-3, an exemplary anti-theft ring assembly 10 used to deter theft of a ring 12 is illustrated. The anti-theft ring assembly 10 includes a product engagement member 14 for supporting the ring and providing an attachment mechanism to an anchoring device 16. A display for supporting the anti-theft ring assembly 10 and displaying ring 12 is also provided, the display being a box 18 in the present embodiment. The box 18 may be any conventional ring box, and may include a base 18*a* and a cover 18*b* that engages the base in a closed position, lining 18*c* and cushion 18*d* having an opening 18*e* for receiving ring 12 therein. An EAS marker 19 (FIG. 18) may be secured to the box 18, for example on the bottom where it would be visible to a consumer, or under the lining 18*c* where it would not be visible to the consumer. The box may have shapes other than the square shape illustrated, may include fewer features than illustrated, or may include additional features, as desired. In the present embodiment, box 18 supports the anti-theft ring assembly 10 and provides an attractive display for ring 12.

Figure 4:
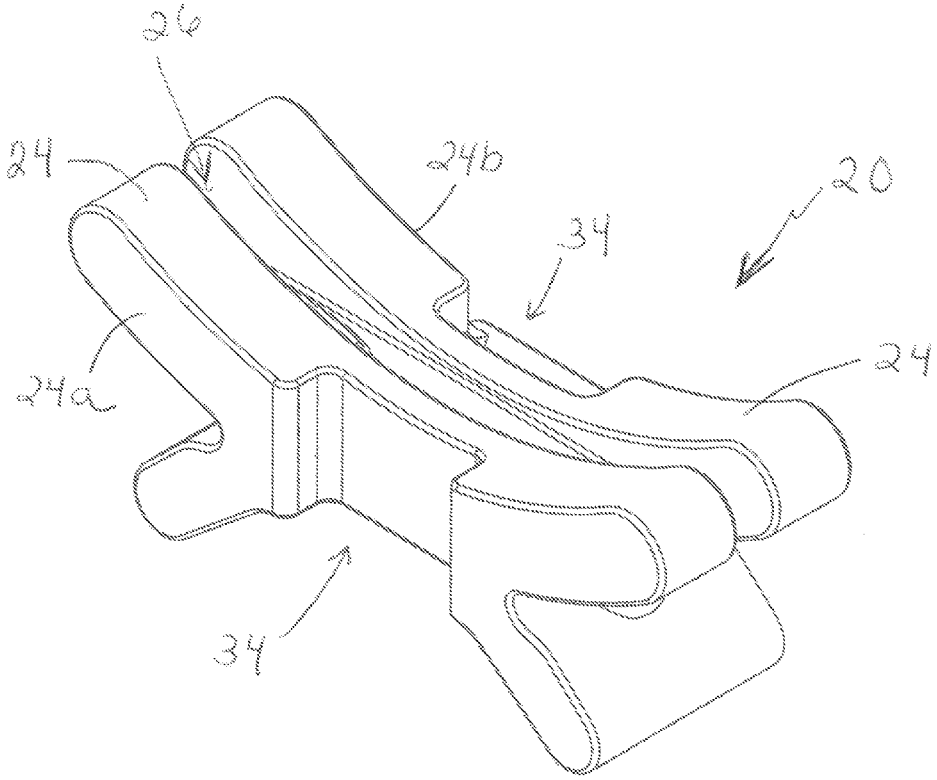
FIG. 4 is a front, perspective view of the display member of the anti-theft ring assembly of FIG. 1.
Figure 15:
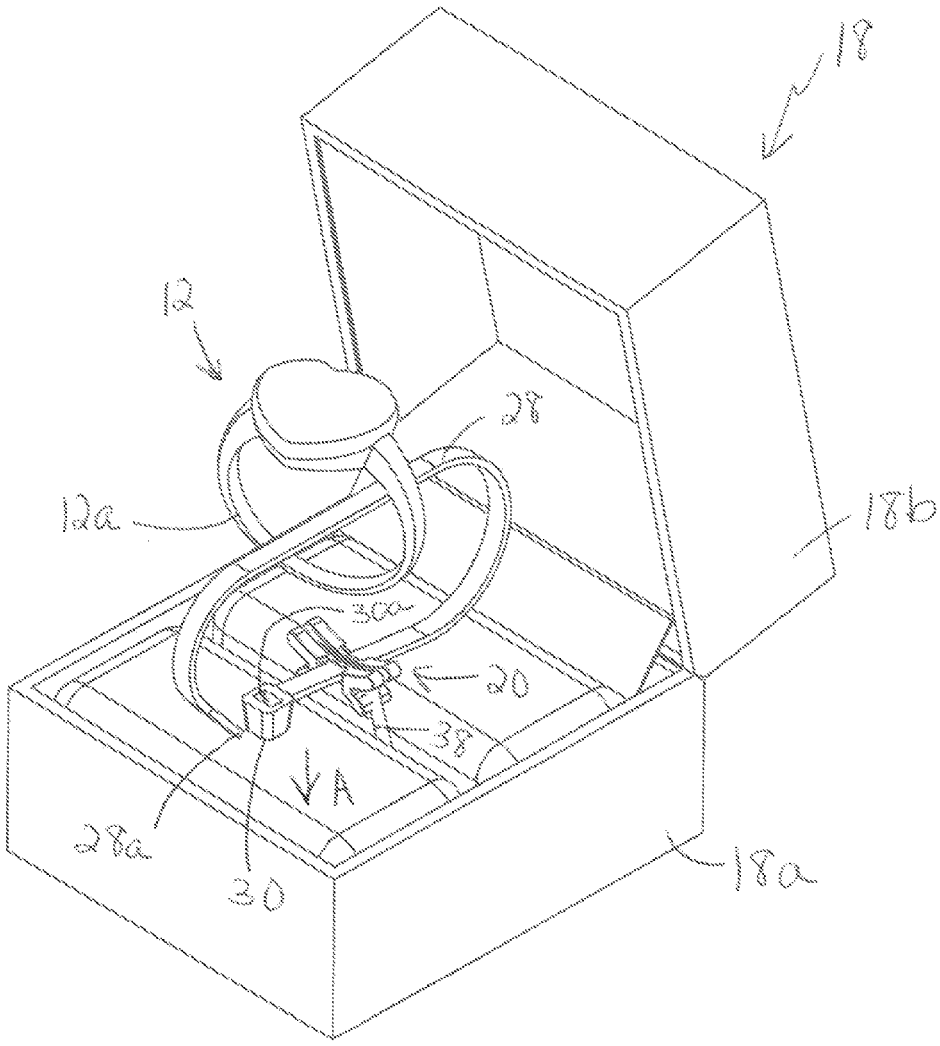
FIG. 15 is a perspective view of the anti-theft ring assembly of FIG. 14 during a assembly of the product engagement member and product within the box in an open position.

The product engagement member 14 of anti-theft ring assembly 10 includes a display member 20 that supports the ring 12 during use and a securing member 22 that attaches the ring 12 to the display member 20. In the present embodiment, the display member 20 includes a seat 24. Referring now to FIGS. 2 and 4, seat 24 preferably has an arcuate shape for receiving and supporting the shank 12*a* of the ring 12 in abutting relation thereon during use. Alternately, the seat may have other shapes or configurations to provide support to the ring. In the present embodiment, securing member 22 attaches the shank 12*a* of the ring to the seat 24. Securing member 22 may take the form of a conventional cable tie 26 including a strap 28 having a first end 28*a*, or tail, which is insertable into an opening 30*a* in head 30 that is supported on the second end 28*b* of the strap (FIG. 15). Alternately, the securing member 22 may take any of a variety of forms, including, for example, a thin, flexible, tear resistant plastic, such as nylon, having a first piece and a second piece with adhesive provided on an inner surface of each piece in order to secure the pieces to each other and around the shank during use.

Figure 5:
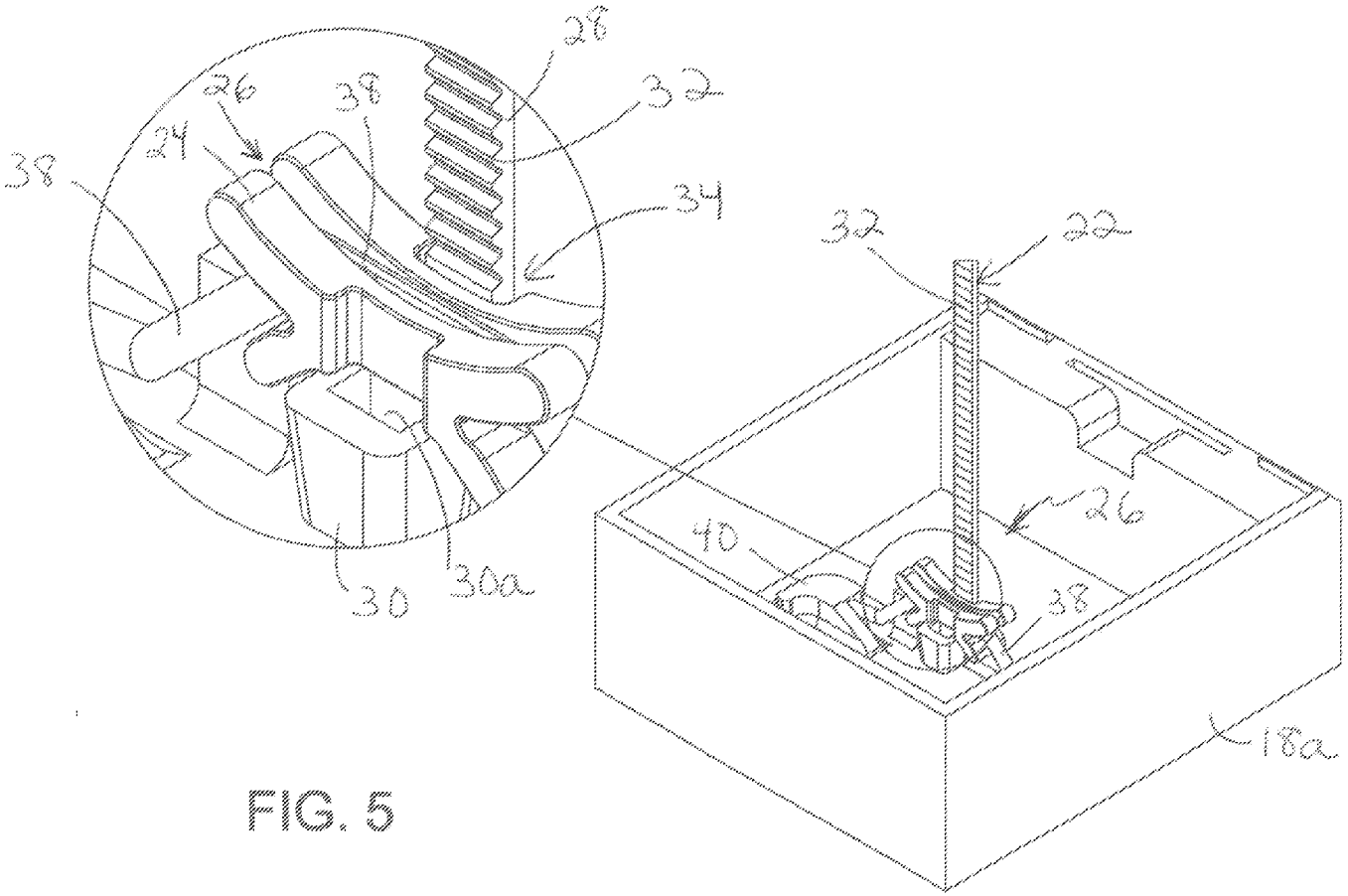
FIG. 5 is an enlarged and perspective view of the product engagement member and backing support of the anti-theft ring assembly of FIG. 1 during assembly within the box.
Figure 6:
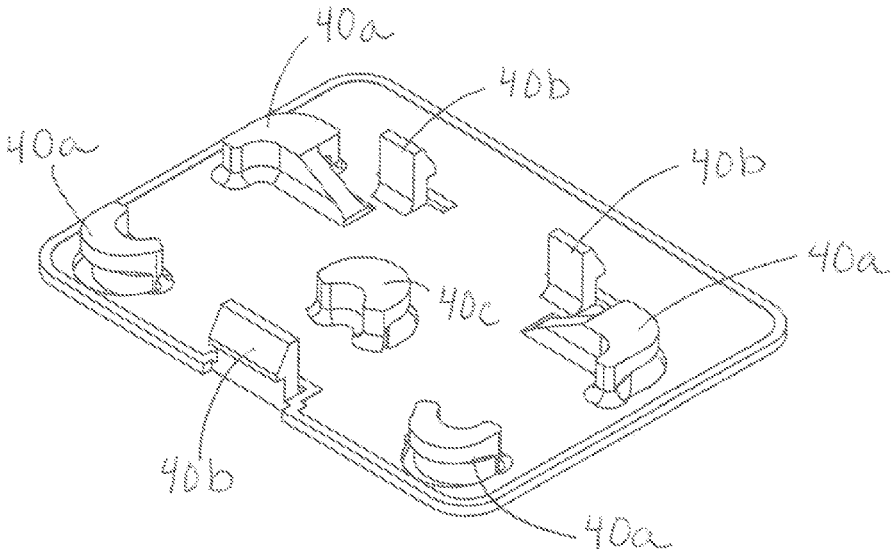
FIG. 6 is a top, perspective view of the support member of the anti-theft ring assembly of FIG. 1.
Figure 7:
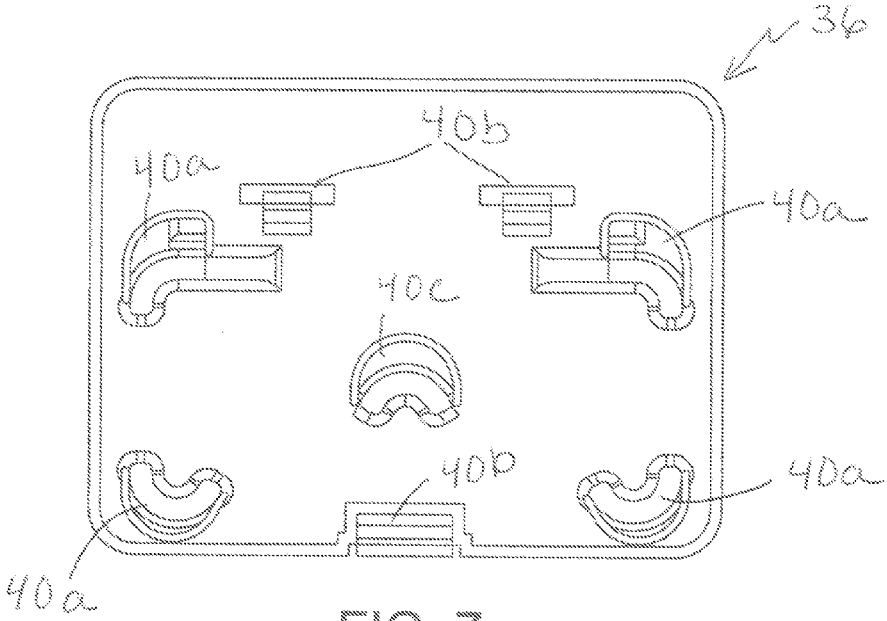
FIG. 7 is a bottom, perspective view of the support member of the anti-theft ring assembly of FIG. 1.

If a conventional-style cable tie is utilized, the strap 28 may include a plurality of teeth 32 that engage a pawl supported within the head 30. In use, the pawl rides up the slope of the teeth 32 when the tail 28*a* is inserted in a first direction into opening 30*a* within head 30. The pawl engages the backside of the teeth 32 upon movement of the strap 28 in a second direction to prevent removal of the strap 28 from the head 30. The pawl and teeth allow the strap 28 to be adjusted around the shank 12*a* so that the strap can be tightened around the shank, but not loosened, i.e. the strap 28 can only be moved in one direction within the head 30, to tighten the strap, as is known in the art. Thus, each pull of the strap 30 tightens the strap around the shank 12*a* in an irreversible manner so that the strap 28 cannot be pulled back and loosened. The strap 28 may also rest within an indentation or recess 34 in seat 24 (FIG. 5). The recess 34 helps guide the strap 28 as it is wrapped around a portion of the shank 12*a* and as the tail 28*a* is inserted within the head 30 and the strap 28 is adjusted therein to secure the shank to the seat (FIG. 15). The seat 24 also includes a slot 26 in the present embodiment for receiving a portion of the anchoring device 16 therein, as described in greater detail below.

Referring now to FIG. 3 in combination with FIGS. 6-10, anchoring device 16 includes a tether 38 for securing the product engagement member 16 to a support member 36, the tether 38 allowing removal of the product engagement member and ring 12 from within the box 18, while remaining secured to the box 18. In the present embodiment the tether 38 is made of an elastic cord of sufficient stretch and strength to allow the ring 12 to be removed from within the box 18 an adequate distance to be comfortably tried on by a customer (FIGS. 2-3), and thereafter the tether 38 helps to return the ring to the box 18. The tether 38 may include a first end and second end 38*a,b* tied together to form a knot 38*c* (FIG. 10), or the tether may be otherwise formed. For example, the first and second ends 38*a,b* may be secured by an adhesive or a fastener, as would be known to those of skill in the art. Alternately, the first and second ends 38*a,b* need not be secured together but may instead be secured separately to the support member 36. Tether 38 is received within slot 26 of seat 24 as best shown in FIG. 5, and is looped or wound around posts and protrusions 40 of support member 36 in order to connect the tether 38 to the support member 36. Alternately, tether 38 may be secured to the support member 36 in any of a variety of manners other than posts and protrusions, for example, openings may be provided and the tether may be inserted through the openings.

Figure 8:
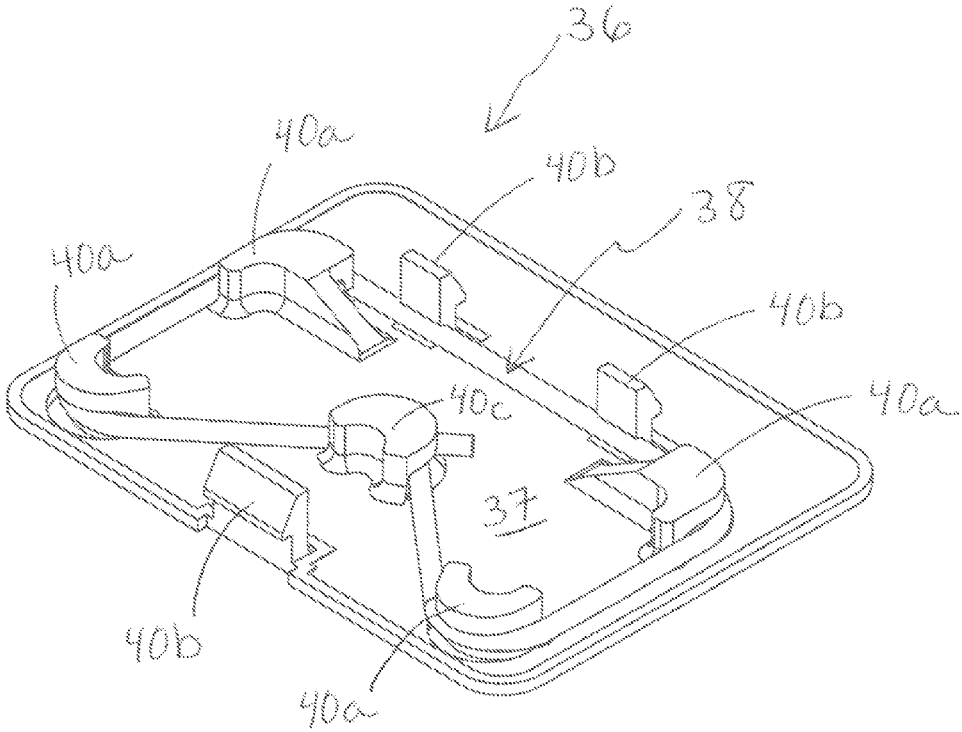
FIG. 8 a top, perspective view of the support member of the anti-theft ring assembly of FIG. 4 with the tether wound thereabout.
Figure 9:
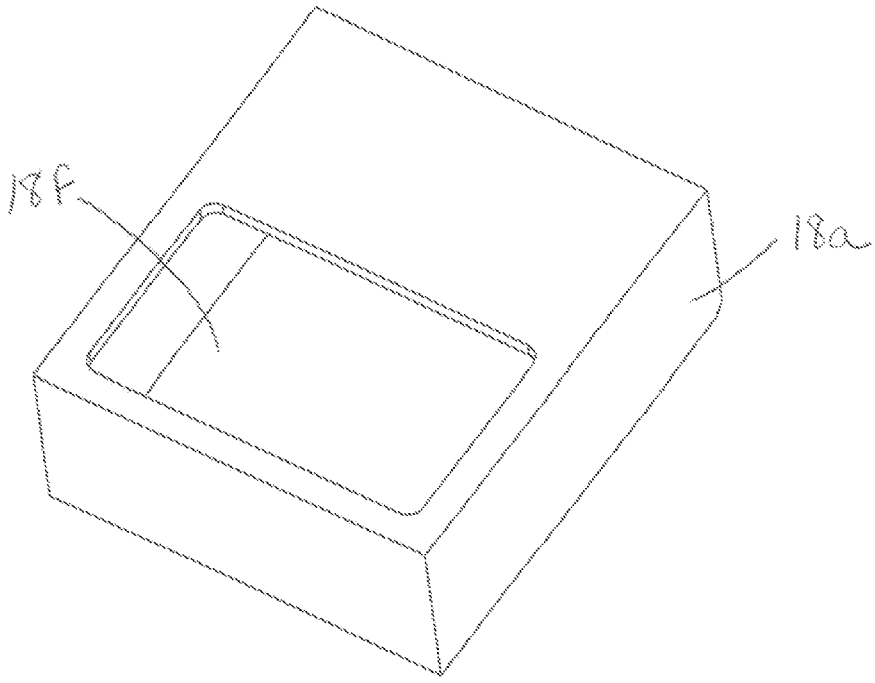
FIG. 9 is bottom view of an exemplary box for use with the anti-theft ring assembly of FIG. 1.
Figure 10:
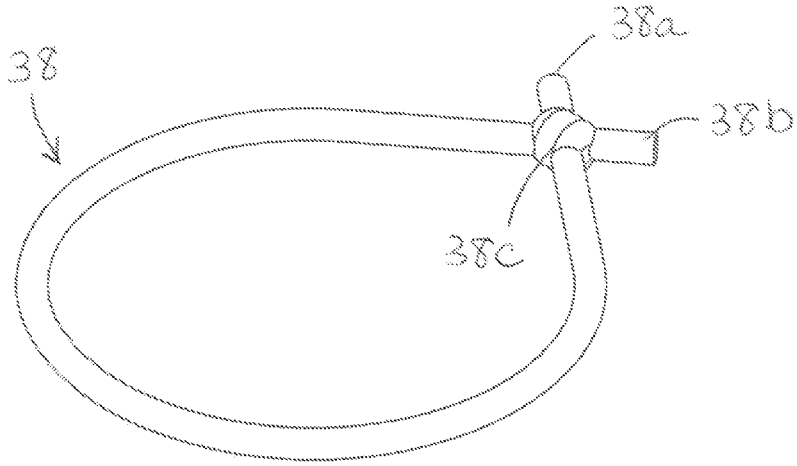
FIG. 10 is a perspective view of the tether of the anti-theft ring assembly of FIG. 1.
Figure 11:
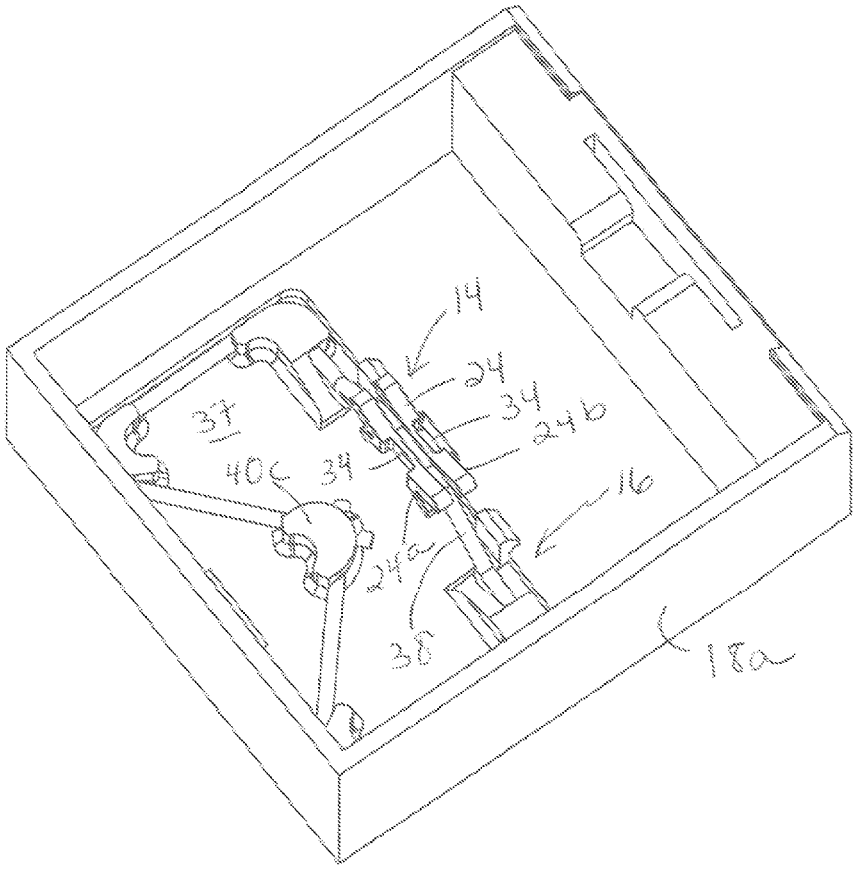
FIG. 11 is a top, perspective view of the anti-theft ring assembly of FIG. 1 during assembly of the anchoring device and seat within the base of the box.
Figure 12:
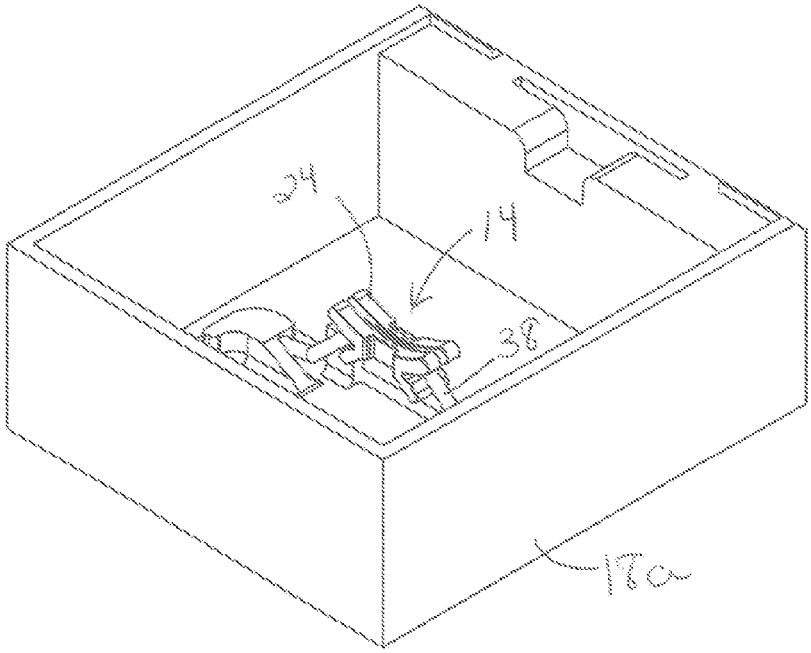
FIG. 12 is a perspective view of the anti-theft ring assembly of FIG. 11.

In the present embodiment, support member 36 is sized to fit within base 18*a* of box 18, for example within an opening 18*f* in base 18*a* (FIG. 9). Alternately, the support member 36 can be supported within the bottom of base 18*a*, not through an opening. The support member 36 includes a base 37 that may be formed of a rigid support material, such as plastic, and includes multiple protrusions or posts 40 supported on the base 37 for guiding and securing the tether 38 to the support member 36. In the present embodiment, four corner posts 40*a* that include rounded edges to guide and turn the tether 38 around a corner are provided, as are intermediate posts 40*b* that can be used to further guide the tether 38, and a center protrusion 40*c* that can be used to center the product engagement member 14 after it has been retracted and returned to within the box 18. The posts 40 secure the tether to the box 18 to help prevent unauthorized removal of the ring 12 by breaking the tether, and guide the tether 38 so that the ring returns to the same general location within the box, for example a generally central location. As shown in FIG. 8, not all of the posts 40 need be utilized in each embodiment, and the present disclosure is not limited to a particular number, placement, shape or size of the posts.

Use of the anti-theft tag ring assembly will now be explained with reference to FIGS. 8 and 11-18.

Figure 13:
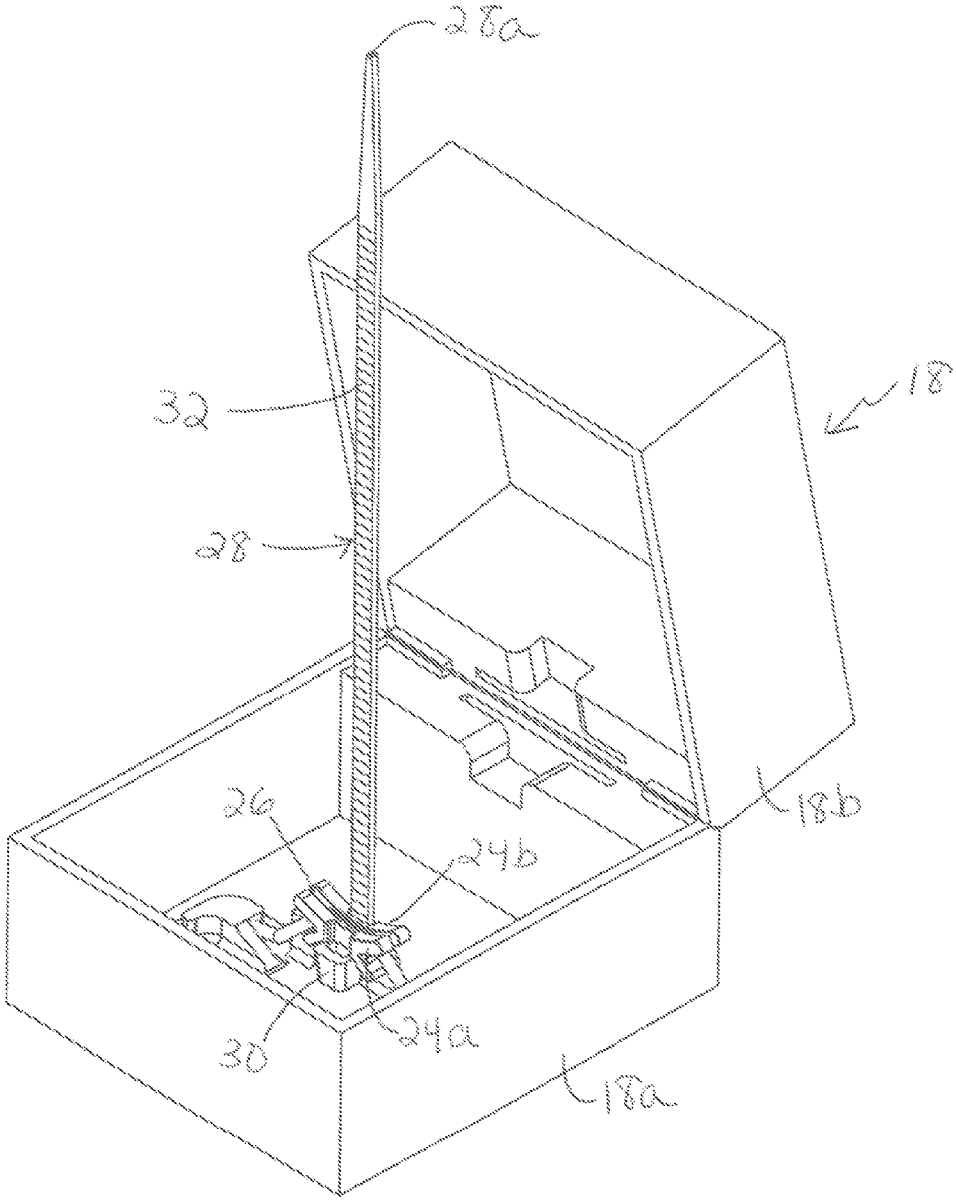
FIG. 13 is a perspective view of the anti-theft ring assembly of FIG. 12 during assembly of the securing member within the box in an open position.
Figure 14:
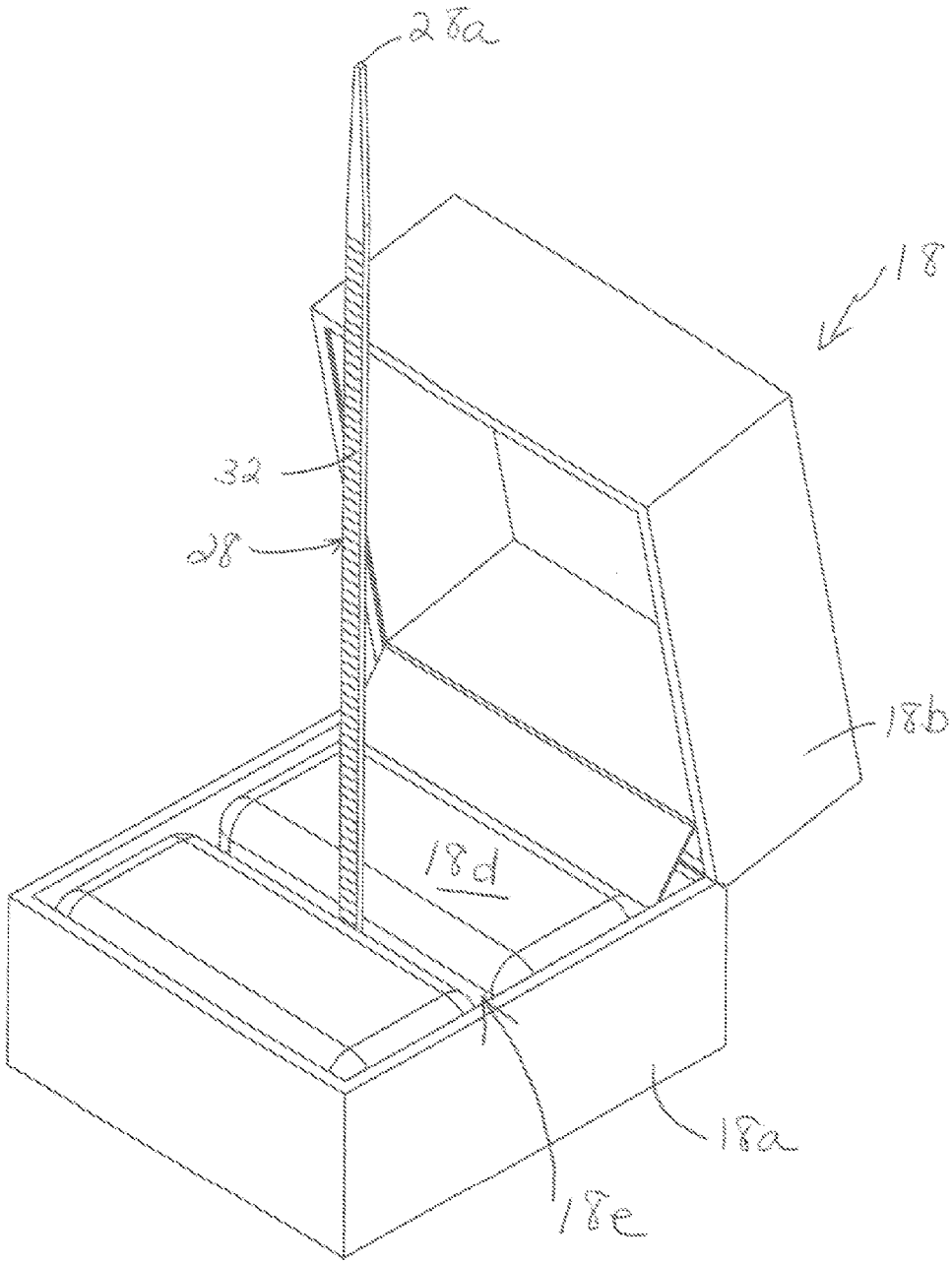
FIG. 14 is a perspective view of the anti-theft ring assembly of FIG. 13 during assembly of the cushion within the box in an open position.
Figure 16:
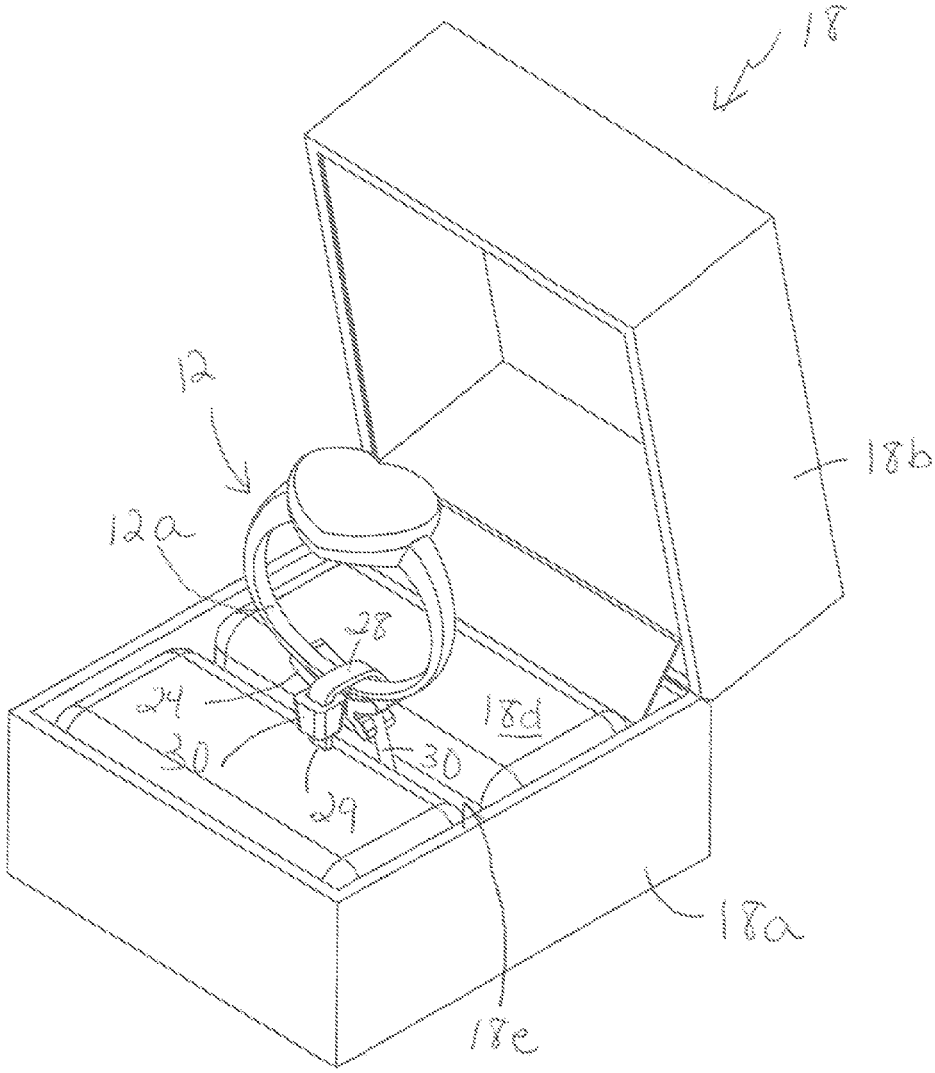
FIG. 16 is a perspective view of the anti-theft ring assembly of FIG. 15 during final assembly of the product engagement member and product within the box in an open position.
Figure 17:
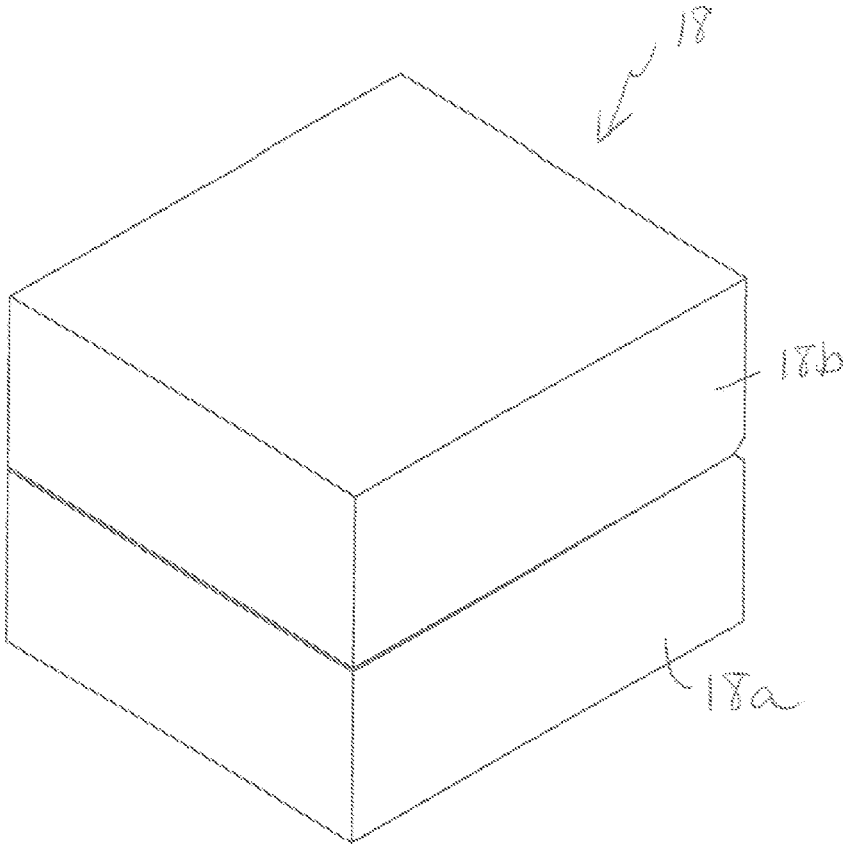
FIG. 17 is a perspective view of the anti-theft ring assembly of FIG. 1 with the box in a closed position.

In use, tether 38 is looped or wound around posts and protrusions 40*a-c* of support member 36 to secure the tether to the support member. The tether 38 is also received within slot 26 of seat 24 to attach the tether to the product engagement member 14. The support member 36 is secured to or within the base of box 18 at any point during the assembly process, for example by the use of adhesive or other fastening methods. Once the tether is engaged with the support member 36 and the seat 24, the product, i.e. ring 12 can be secured to the seat 24. As best shown in FIGS. 13-16, in the present embodiment the securing member 22 is placed under the seat 24 such that the head 30 is adjacent a first side 24*a* of the seat, and the strap 28 extends under the seat to a second side 24*b* of the seat (FIG. 13). As described above, the strap 28 may also rest within an indentation or recess 34 in seat 24 to help guide the strap 28 during assembly. If a cushion 18*d* is desired for aesthetics, it may be inserted within the box either before or after the tether 38 is received within seat 24, and before or after the securing member 22 is positioned adjacent the seat 24. If the cushion 18*d* is inserted after the tether is received within the seat 24 and after the securing member 22 is positioned, both the seat 24 and the securing member 22 are inserted through opening 18*e* in the cushion (FIG. 14). Once inserted through the opening 18*e*, the strap 28 is wrapped around a portion of the shank 12*a* of ring 12 and the tail 28*a* is inserted within the head 30. The tail 28*a* may then be pulled through head 30 in the direction of arrow "A" in order to adjust strap 28 to tighten it around the shank 12*a*, thus securing the ring to the seat. In the present embodiment, strap 28 can only move in the direction of arrow "A", i.e. to tighten the strap because of the pawl and tooth arrangement described above. Once fully inserted, the tail 28*a* may be cut so that only a small portion 29 of the strap 28 extends from head 30 (FIG. 16). The box may thereafter be closed (FIG. 17) and upon opening the box, the consumer sees a ring displayed in a conventional manner (FIG. 1). However, if the consumer tries to remove the ring 12, the tether 38 extends from within slot 18*e* to allow the ring 12 to extend, but remain anchored to the box 18, thus allowing the ring 12 to be tried on but not removed from the box 18.

It will be understood by those skilled in the art that various changes in form and details may be made without departing from the spirit and scope of the invention as defined by the appended claims. For example, the materials disclosed herein may be readily changed, as may the dimensions and geometric configurations of the components described herein, i.e. the box can have other, the support member can have on or more posts, etc. Also, the anti-theft ring assembly may find use with items other than a box as disclosed herein for example a display card. Therefore, the above description should not be construed as limiting, but merely as exemplifications of preferred embodiments. Those skilled in the art will envision other modifications within the scope, spirit and intent of the invention.

What is claimed is:

1. An anti-theft ring assembly comprising:

a product engagement member including a display member constructed and arranged to support a ring and a securing member constructed and arranged to secure the ring to the display member;

an anchoring device including a tether constructed and arranged to secure the product engagement member to a support member disposed within a display, the support member including a base and one or more posts constructed and arranged to guide and secure the tether to the support member; and wherein during use the tether allows the ring to be removed a distance from the display while remaining secured to the display.

2. The anti-theft ring assembly of claim 1, wherein the display member includes a seat constructed and arranged to support a shank of the ring thereon and wherein a portion of the tether is supported by the seat.

3. The anti-theft ring assembly of claim 2, wherein the seat has an arcuate shape and includes a slot configured and dimensioned to receive the portion of the tether therein.

4. The anti-theft ring assembly of claim 2, wherein the securing member is a strap.

5. The anti-theft ring assembly of claim 4, wherein the strap includes a first end insertable into an opening in a head supported on a second end of the strap, the head including a pawl supported in the opening and the strap including a plurality of teeth such the strap can be selectively tightened around the shank by moving the strap in a first direction and such that a consumer is deterred from moving the strap in second direction, opposite the first, to loosen the strap.

6. The anti-theft ring assembly of claim 1, wherein the tether comprises a stretchable cord.

7. The anti-theft ring assembly of claim 1, wherein the one or more posts includes one or more protrusions supported on the base to guide and secure the tether to the support member.

8. The anti-theft ring assembly of claim 1, wherein the display is a box.

9. The anti-theft ring assembly of claim 1, in combination with an EAS marker.

10. An anti-theft ring assembly comprising:

a product engagement member including a display member having a seat constructed and arranged to support a ring, and a securing member constructed and arranged to secure the ring to the display member;

an anchoring device including a stretchable tether constructed and arranged to engage the seat and also including a support member constructed and arranged to secure the tether to a display, the support member including a base and one or more posts constructed and arranged to guide and secure the tether to the support member; and wherein during use the stretchable tether is supported by the seat and engaged with the support member allowing the ring to be removed a distance from the display while remaining secured to the display by the tether.

11. The anti-theft ring assembly of claim 10, wherein the seat has a shape constructed and arranged to receive the shank of the ring in abutting relation thereon and wherein a portion of the tether is supported by the seat.

12. The anti-theft ring assembly of claim 11, wherein the seat has an arcuate shape and includes a slot configured and dimensioned to receive the portion of the tether therein.

13. The anti-theft ring assembly of claim 10, wherein the securing member is a strap.

14. The anti-theft ring assembly of claim 13, wherein the strap includes a first end insertable into an opening in a head supported on a second end of the strap, the head including a pawl supported in the opening and the strap including a plurality of teeth such the strap can be selectively tightened around the shank by moving the strap in a first direction and such that a consumer is deterred from moving the strap in second direction, opposite the first, to loosen the strap.

15. The anti-theft ring assembly of claim 10, wherein the stretchable tether comprises an elastic cord.

16. The anti-theft ring assembly of claim 10, wherein the one or more posts includes one or more protrusions supported on the base to guide and secure the tether to the support member.

17. The anti-theft ring assembly of claim 10, wherein the display is a box.

18. The anti-theft ring assembly of claim 10, in combination with an EAS marker.

19. A method of securing a ring to display to deter theft comprising the steps of:

providing a support member including a base and one or more posts constructed and arranged to guide and secure the tether to the support member;

providing a tether in engagement with the support member;

providing a product engagement member including a display member having a seat constructed and arranged to support the ring, and a securing member constructed and arranged to secure the ring to the display member;

securing the support member to the display;

engaging the tether and the product engagement member such that the tether is supported by the product engagement member and engaged with the support member allowing the ring to be removed a distance from the display while remaining secured to the display by the tether;

positioning a shank of the ring in abutting relationship with the seat; and securing the shank of the ring to the display member with the securing member.

20. The method of claim 19, wherein the step of engaging the tether and the product engagement member further comprises the step of inserting a portion of the tether into a slot in the display member.

* * * * *